US006725610B2

(12) United States Patent
Murphy et al.

(10) Patent No.: US 6,725,610 B2
(45) Date of Patent: Apr. 27, 2004

(54) WINDOW SEAL CONSTRUCTION

(75) Inventors: Colin Murphy, Seattle, WA (US); Robert Mills, Seattle, WA (US); Wei Lam, Seattle, WA (US); David Landsburgh, Argyll (GB); Charles Phillips, Seattle, WA (US)

(73) Assignee: Exterior Research, LLC, Seattle, WA (US)

( * ) Notice: Subject to any disclaimer, the term of this patent is extended or adjusted under 35 U.S.C. 154(b) by 26 days.

(21) Appl. No.: 09/814,199

(22) Filed: Mar. 21, 2001

(65) Prior Publication Data

US 2001/0034984 A1 Nov. 1, 2001

Related U.S. Application Data

(60) Provisional application No. 60/191,364, filed on Mar. 22, 2000.

(51) Int. Cl.[7] ..... E06B 7/00; E06B 7/16; E06B 7/12; E04D 1/36

(52) U.S. Cl. ..... 52/58; 52/204.1; 52/204.5; 52/741.4; 52/745.15

(58) Field of Search ..... 52/58–62, 97, 52/302.6, 204.1, 204.5, 741.4, 745.15

(56) References Cited

U.S. PATENT DOCUMENTS

| | | | |
|---|---|---|---|
| 690,648 | A | 1/1902 | Gautschi |
| 1,411,352 | A | 4/1922 | Hawksworth |
| 1,808,336 | A | 6/1931 | Baum |
| 2,363,524 | A | 11/1944 | Hartbauer |
| 4,126,966 | A | 11/1978 | Lobell |
| 4,302,262 | A | 11/1981 | Kay |
| 4,509,999 | A | 4/1985 | Sandor |
| 4,555,882 | A | 12/1985 | Moffitt et al. |
| 4,700,512 | A | 10/1987 | Laska |
| 4,966,819 | A | 10/1990 | Schatz et al. |
| 5,018,333 | A | 5/1991 | Bruhm |

(List continued on next page.)

FOREIGN PATENT DOCUMENTS

| | | |
|---|---|---|
| DE | 1534761 | 9/1969 |
| DE | 296 05 456 U1 | 7/1996 |
| EP | 0 261 907 A2 | 3/1988 |
| EP | O 855 479 A2 | 7/1998 |
| EP | 0 855 479 A3 | 7/1998 |
| EP | 0 974 711 A2 | 1/2000 |
| JP | 3-59285 | 3/1991 |
| JP | 03059285 | 3/1991 |
| JP | 09155896 | 6/1997 |
| NO | 104311 | 7/1964 |

*Primary Examiner*—Robert Canfield
(74) *Attorney, Agent, or Firm*—Carella, Byrne, Bain, Gilfillan, Cecchi et al; Elliot M. Olstein; William Squire

(57) ABSTRACT

A relatively high perm pliable moisture barrier material pliable sheet material exhibits a breathable perm value, e.g., over 0.4, that repels liquid water applied to a surface thereof and which permits water vapor to permeate therethrough in response to a pressure differential thereacross to preclude substantial condensation collection in the interior of said wall at the opening while providing a water barrier to liquid water applied thereto is applied to corners of the window opening in a wall as a plurality of corner seals with leg portions for application to the face of sheathing and leg portions for overlying the sill, jambs and head of the opening at the corners. Flanges may be included for sealing the sheet material to an interior vapor barrier material. Sill, jamb and head seals are applied over the corner seals and over the sill, head and jambs to completely seal the window opening with the sheet material. Weather resistant barrier material is then applied over or under the seals as are conventional metal flashing and sealant beads. Pinholes are substantially eliminated. A retrofit arrangement including corners, sill, jamb and head strips are bonded to the sheathing and to the frame without removing the window and which seals form a high perm continuous moisture seal about the window opening.

25 Claims, 12 Drawing Sheets

U.S. PATENT DOCUMENTS 5,086,596 A 2/1992 Schlyper et al.
5,208,098 A 5/1993 Stover
5,586,415 A 12/1996 Fisher et al.
5,617,687 A * 4/1997 Bussey et al. ..... 52/404.2
5,899,026 A * 5/1999 Williams et al. ..... 52/58
5,924,259 A * 7/1999 Marousek ..... 52/656.1
6,047,507 A * 4/2000 Lappin et al. ..... 52/212
6,098,343 A * 8/2000 Brown et al. ..... 52/11
6,305,130 B1 * 10/2001 Ackerman, Jr. ..... 52/58
6,305,132 B1 * 10/2001 Smith ..... 52/204.1
6,401,401 B1 * 6/2002 Williams ..... 52/58
6,401,402 B1 * 6/2002 Williams ..... 52/58
6,602,809 B1 * 8/2003 Cabrey ..... 442/2

* cited by examiner

FIG. 6
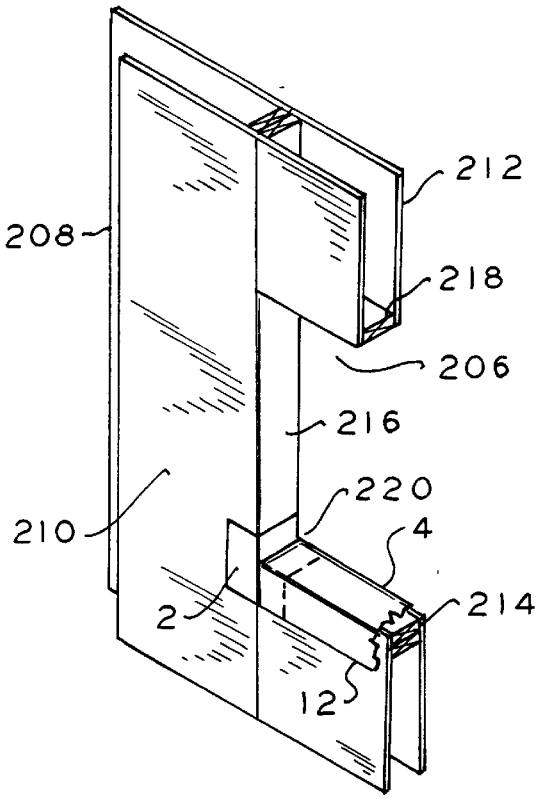
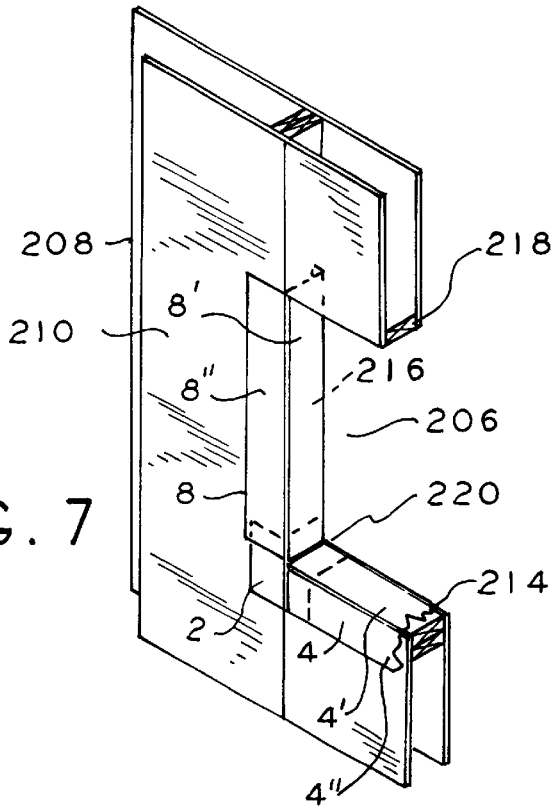
FIG. 7

FIG. 16
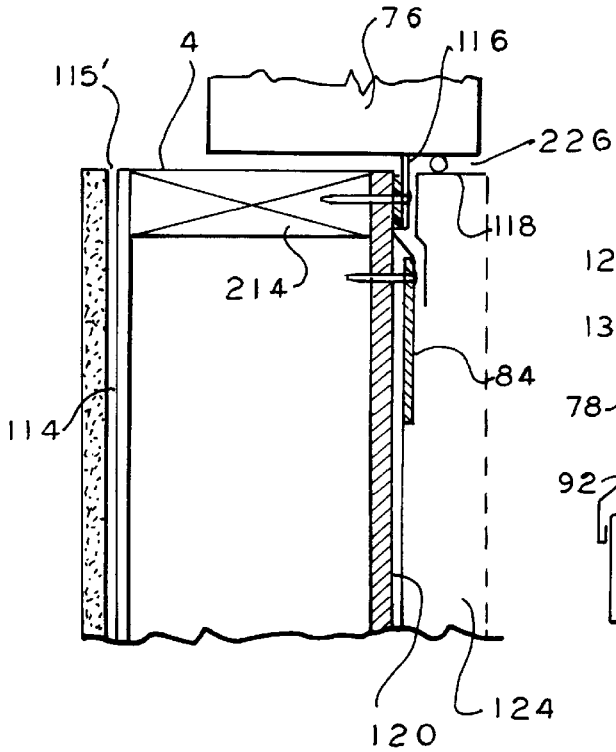
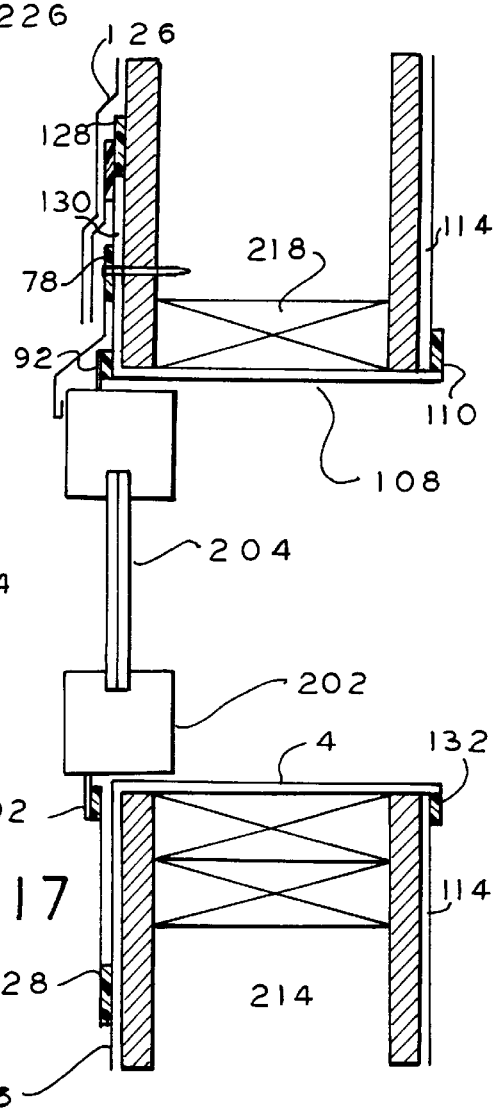
FIG. 17

FIG. 24
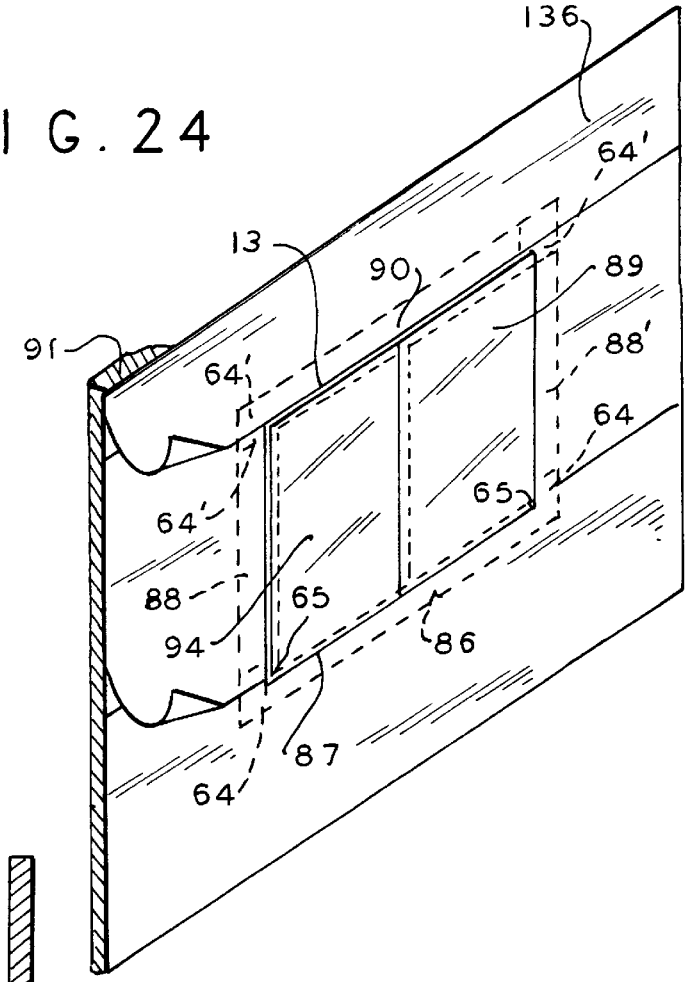
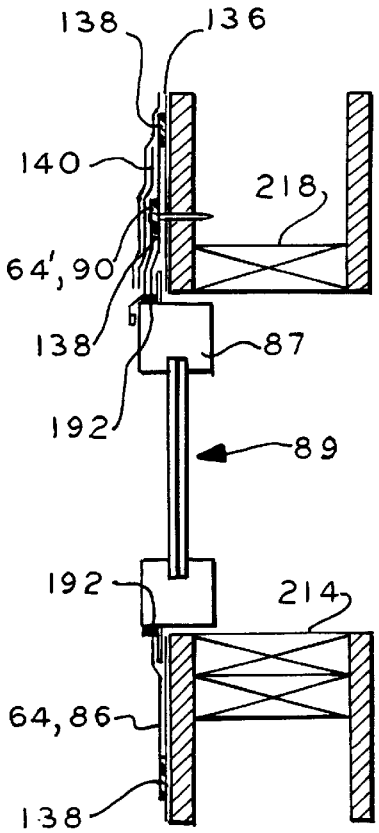
FIG. 23

WINDOW SEAL CONSTRUCTION

This application claims the benefit of Provisional Application No. 60/191,364, filed Mar. 22, 2000.

This invention relates to a window or door construction for sealing window or door frames to a wall.

Development of nail-on windows occurred in the 1970's and originally incorporated aluminum frames and then vinyl frames, which comprise the majority of residential windows.

The window assembly must be water tight within the exterior wall and must be flashed. The flashing seals the window into the exterior wall opening to establish resistance to air and water infiltration. The degree of water resistance should match that of the adjoining wall cladding while the material must breath to allow for outward migration of moisture vapor.

Windows are prefabricated assemblies that are installed into typical frame or other construction walls. The problem of installation of such assemblies is to provide seals for resisting water and moisture penetration at the transition between window frame and the wall structure's 'rough opening'. Windows typically are sealed to the frames with flashing materials in combination with adjoining weather resistive barrier (WRB) materials. Asphalt-based flashings and laminated flashings and building papers do not resist constant exposure to water or continuous cycles of wetting and drying commonly associated with the subject portion of the building envelope.

Window assemblies of recent design have integral nailing flanges which are used to nail the assemblies to the wall frame construction. The altered methods of window installation inherent to these 'nail-on windows' require an altered method of flashing the window to the exterior wall weatherproofing.

Nailing flanges provide a method of securing the window to the exterior wall framing. They also provide a flat surface onto which a flashing component and sealant can be applied and compressed to create a waterproof seal. Typically, the nailing flange is used as a transition point for the weather resistive barrier installed at adjoining wall areas.

In FIG. 1, a typical nail-on window frame assembly 6 is shown. The assembly 6 includes a glass pane 94 set in a frame 96. Flashing materials 98, 99 and 100 overlap the nailing flanges on the respective head 102, jamb 104 sides of the frame 96 and under the sill flange 106. The flashing materials 98, 99 and 100 are typically of polyethylene material or the like of low permeance, e.g., about 0.30 perms, exhibiting negligible moisture vapor penetration therethrough. The flashing materials 98, 99 and 100 are applied sequentially as separate strips resulting in overlap at regions A, B and so on at each of the corners. The flashing materials are applied with an adhesive to the mating wall construction. Such barriers are available as Moistop E-Z Seal from Fortifiber of Los Angeles, Calif. The material has a vapor permeance of less than about 0.3 perms, as determined following ASTM E96 procedures. This material also is not heat weldable. Other flashing materials may utilize modified bitumen membranes such as Blueskin and Vycor, trademarks for materials used for such membranes as known in this industry.

Due to construction sequencing, the window assembly 6 is typically installed before the flashing materials 98, 99, and 100. In many instances, the flashing materials are improperly lapped onto the nailing flange resulting in leakage. As an improvement, strips of weather resistive barrier or special flashing material (not shown) are installed under the nailing flange on three sides (sill and both jambs) at the time of the window installation. This provides a large area of transition and a material assisting in the formation of a compression seal under the window nailing flange. The seal is, in some applications, augmented by the use of a sealant bead between the underside of the nailing flange and top side of the flashing material. Since the window assemblies 6 are installed during the framing and sheathing process, the flashings are exposed to the weather and can be damaged by weather/exposure.

Once a window assembly with an integral window flange is installed, it is difficult to install a workable flashing without the removal of the window from the opening. The removal can damage the interior window trim and the insulation installed in the framing void between the window profile and the wood framing.

In an effort to design assemblies that can be installed to the outside of a window profile, self-adhering membranes such as the Moistop E-Z Seal noted above have been employed to provide a waterproofing seal. These membranes typically have a very low perm rating trapping moisture vapor at the window perimeter. This can result in deterioration of the wood framing and of the window profile if constructed of wood.

Flashing materials have been developed to wrap the wood framing to the building interior to protect the wood framing from leakage and from the effects of moisture vapor entrapment and condensation accumulation. These materials typically are joined by overlaps, and, in some cases, with a tape to seal the overlaps.

The evolution of both methods of application and materials offered to the market has resulted in the lack of a standardized method of installation and a variety of materials, not all of which are compatible with various weather resistive barriers.

All windows do not provide closed assemblies, and water can leak through the frame that is constructed of individual components mechanically secured at the interior corners. Flashing plays an important role in moisture control of such windows.

Windows are fabricated with mullions, both horizontal and vertical, that are mechanically secured to the window profile and which can leak water. Thus a strong durable seal is needed that can form a full weather tight seal over the entire window opening tying the exterior weather resistive barrier to the interior vapor barrier retarder with an effective flashing seal. While overlaps of prior art strip seals shown in FIG. 1 will shed water, they do not keep water from entering due to pressure differentials. Moreover, joints at the sill create pinholes where the strips intersect at changes of plane. These pinholes are sources of water entry both by gravity flow of water as well as due to pressure differentials. Typically such pinholes may be sealed with dabs of sealant which is not a reliable permanent seal.

Most current flashing assemblies require removal of the window for installation. A flashing material that can be applied to the installed window is a self adhering membrane that is bonded to the outer flange of the window and to the exterior sheathing. That sheathing is usually exterior grade gypsum or engineered wood such as plywood or oriented strand board. Self adhering membranes are usually made of modified bitumen. The combination of the modified bitumen and the adhesive creates a very low perm rating at the seal. This can result in the collection of condensation under the flashing transition and can damage the underlying moisture sensitive components.

Prior to the development of nail-on windows, windows were typically flashed with a metal pan under the window or door. The pan was formed typically of metal or some other rigid material forming a tray. The jamb edges and the back of the sill were turned up to form end dams. The vertical joints were sealed with a sealant or were soldered or welded. The so called tray was especially fabricated to conform to the dimensions of the associated opening. The tray is installed at the ends of the jambs (vertical) or with clips on the rear side. Flashing strips were installed at the jambs running into the tray. Water entering at the head or jambs was directed to the sill tray. The sill tray remained open at the bottom to allow water that enters the assembly to drain out.

Sill trays cannot be used with nail on windows without modification by removing a bottom flange to allow water to exit the assembly. This reduces the strength of the attachment with one plane not attached. Due to potential of compression of wood frame construction, the head of the window is not attached to allow for movement. An alternate method of attachment would be required to modify a nail-on window for use with a sill tray. Sill trays are typically used for flangeless windows that sit in a tray. The nail-on concept is based on sealing the entire window into the opening and creating an air and water barrier on all four sides, yet allowing any water vapor to transfer through the flashing.

There is commercially available a sill tray that is adjustable to fit different size openings.

U.S. Pat. No. 4,555,882 discloses a moisture guard, i.e., a sill tray, for window frames, door jambs and so on. The guard comprises a metallic facing fixed to a rigid plastic molding such as ABS plastic. The sill of a window frame or the sill of a door frame is seated on the metallic facing. The moisture guard has a Z shaped cross section. An integrally formed upstanding rear flange is at the rear edge of the base and an integrally formed depending front flange is at the forward front edge of the base. At an end of the base is formed an end flange with an upstanding vertical wall and with a vertical side wall. The height of the vertical side wall is coextensive with the height of the upstanding end wall and the vertical side wall extends to the depth of the depending front flange. This structure is somewhat as described above in connection with sill trays and has the disadvantages as described therewith. Because the material is of low permeance, it does not allow moisture within the structure to escape. The present inventors recognize that this structure is not as desirable for sealing nail-on window frames and may still be subject to leakage and vapor damage due to interior condensation. It is also not especially adaptable to headers and vertical jambs.

Other flashing and weather stripping arrangements are disclosed in U.S. Pat. Nos. 690,648; 1,411,352; 1,808,336; 2,363,524; 4,126,966; 4,302,262; 4,509,999; 4,700,512; 4,966,819; 5,018,333; 5,086,596 and 5,586,415. None of these are believed to solve the problems discussed herein.

There have been available various methods to form seals and create gaskets at flanges. There has yet to be provided an effective yet flexible system that provides a complete watertight seal out of flexible components that will form to virtually any substrate, eliminate pinholes, provide a durable weatherproofing, easily be sealed to adjoining components, and easily integrated with the wall vapor barrier.

A seal construction according to the present invention is for a nail-on window or door frame, the frame for installation in a window or door opening formed by a horizontal sill, a horizontal head and vertical jambs connecting the sill to the head, the wall at the sill, head and jambs having front and rear faces. The seal construction comprises an integral unitary corner pliable sheet material sealing member that repels liquid water applied to a surface thereof and which permits water vapor to permeate therethrough in response to a pressure differential thereacross to preclude substantial moisture vapor entrapment and condensation collection in the interior of said wall at the window opening while providing a water barrier to liquid water applied thereto. The seal member comprises a first portion for overlying a selected portion of one of the front face at the head and sill, a second portion normal to the first portion and sealingly connected to the first portion for overlying a portion of the jamb at the selected one of the head and sill and a third portion sealingly connected to and normal to the first and second portions for overlying the front face adjacent to the selected one of the head and sill portions and adjacent to the jamb portion.

In one aspect, at least a portion of a first surface of the seal member includes embedded reinforcing fibers for enhancing sealant adherence to the first surface.

In a further aspect, the seal member comprises polyethylene.

In a further aspect, the first and second portions are each planar connected by a right angle joint therebetween, the third portion comprising an L-shaped member having a first leg depending from the first portion at a right angle thereto and a second leg extending at a right angle to the first leg and extending from the second portion at a right angle thereto.

In a further aspect, a fourth rear portion overlies a portion of the rear face of the selected one of the sill and head, the fourth portion depending from the first portion and juxtaposed with the first leg, and a fifth rear portion extending from the second portion juxtaposed with the second leg for overlying a portion of the rear face of the jamb.

Preferably the first and second portions and a portion of the first and second legs are formed of one piece sheet material, further including a triangular interface section between and bonded to at least a portion of the first and second legs.

In a further aspect, the first and second portions comprise integral one piece sheet material, the first and second portions each having a flange depending therefrom for overlying the rear face and comprising an L-shaped planar sheet member.

In a still further aspect, a method of making a seal construction for a window or door opening in a wall for receiving a nail-on frame for insertion into the opening formed which is formed by a horizontal sill, a horizontal head and vertical jambs connecting the sill to the head, the wall at the sill, head and jambs having front and rear faces. The method comprises forming a flat pliable water impervious first sheet having a permeance sufficient to permit water vaper to permeate therethrough to preclude moisture vapor entrapment and condensation from substantially accumulating on a side thereof at a first edge. A slit is formed in the sheet and has opposing edges. The opposing edges of the slit are spread apart and sealingly attached to a second sheet made of the same material as the first sheet to form a one piece sheet member having a sill or head portion for overlying a sill or head of the opening, a jamb portion for overlying a portion of the jamb normal to the sill or head portion and a front face portion for overlying the front face of the wall at the sill or head and adjacent to the jamb.

The method further comprises forming a rear flange portion extending from a second edge of the sheet material opposite the first edge for overlying a portion of the rear face at the sill or head and jamb.

In a further aspect, the sheet material has a first fold line extending thereacross to opposing second and third edges of the sheet material and a second fold line extending from a fourth edge of the sheet material medially the second and third edges normal to the first fold line and terminating at the first fold line, the slit extending from the junction of the first and second fold lines to the first edge.

In a further aspect, a method of making a seal for a nail-on a window or door opening in a wall, the opening being formed by a horizontal sill, a horizontal head and vertical jambs connecting the sill to the head in the wall, the wall at the sill, head and jambs having front and rear faces, comprises forming a corner seal from a flat sheet of a liquid water repellant pliable material having a permeance sufficient to permit water vapor to pass therethrough in response to a pressure differential across opposing sides of the material to preclude moisture vapor entrapment and condensation on a first side thereof while repelling liquid water incident thereon on a second side, the corner seal comprising a flat first portion for overlying the sill or head and a flat second portion for overlying the jamb, the second portion being integral and one piece with the first portion and forming a flat front face member sealingly attached to the first and second portions for overlying a portion of the front face of the wall at the sill or head and jamb.

In a still further aspect, a method of sealing a window or a door opening in a wall, the opening being formed by a horizontal sill, a horizontal head and vertical jambs connecting the sill and head in the wall, the wall at the sill, head and jambs having front and rear faces, comprises forming a corner seal member of pliable sheet material that repels liquid water applied to a surface thereof and which permits water vapor to permeate therethrough in response to a pressure differential thereacross, the seal member comprising a first portion for overlying a selected portion of one of the sill or head, a second portion normal to the first portion and sealingly connected to the first portion for overlying a portion of the jamb at the selected one of the head and sill and a third front face portion sealingly connected to and normal to the first and second portions for overlying the face of the wall adjacent to the selected one of the head and sill portions and adjacent to the jamb portion. Then attaching the seal member to each of two lower interior corners of the opening at the juncture of the sill and jambs at each end of the sill. Then sill, head and jamb seal members are formed each comprising an elongated L-shape in section member formed of the pliable sheet material and including a first portion for overlying a selected sill, head and jamb and a second portion for overlying the front face; attaching the sill member over the first portions of the corner seal member at each lower corner of the opening and over the sill and over the front face at the sill; and attaching the jamb seal to each vertical jamb over the second jamb portions of each attached corner seal member at the lower corners and over the front face. Then a corner seal member second portion is attached over the jamb seal members at each upper corner of the opening and the first portion over a portion of the head. Finally a head seal member is attached over the first portions of the corner seal members at the head-jamb corners of the frame, and over the head and face.

A retrofit seal construction according to a further aspect of the present invention is for sealing an installed window or door frame in a wall having a front face and a rear face, the frame for enclosing a window or door opening formed by a horizontal sill, a horizontal head and vertical jambs connecting the sill to the head in the wall. The seal construction comprises an integral unitary corner member seal formed of pliable sheet material exhibiting a breathable perm value that repels liquid water applied to a surface thereof and which permits water vapor to permeate therethrough in response to a pressure differential thereacross to preclude substantial condensation collection in the interior of said wall at the opening while providing a water barrier to liquid water applied thereto. The corner member seal comprises an L-shaped planar element of the material with a first leg and a second leg normal to the first leg for overlying the front face adjacent to the sill or head and jamb. A first flange extends outwardly from the first leg for overlying and sealingly attachment to the frame at the sill or head and a second flange extends outwardly from the second leg at a right angle to the first flange for overlying and sealing attachment to the frame at the jamb, the first and second flanges being sealing joined to each other and to the legs at the juncture therebetween and the legs.

A method of sealing a window or door opening in a wall according to a further aspect of the present invention comprises applying pliable sheet material exhibiting a breathable perm value greater than 0.4 that repels liquid water applied to a surface thereof and which permits water vapor to permeate therethrough in response to a pressure differential thereacross to preclude substantial condensation collection in the interior of the wall at the opening while providing a water barrier to liquid water applied thereto to the sill, jambs and head interior surfaces of the window or door opening and to the exterior sheathing at the sill, jambs and head in a bonded plurality of strips of the material.

IN THE DRAWING

Figure 1:
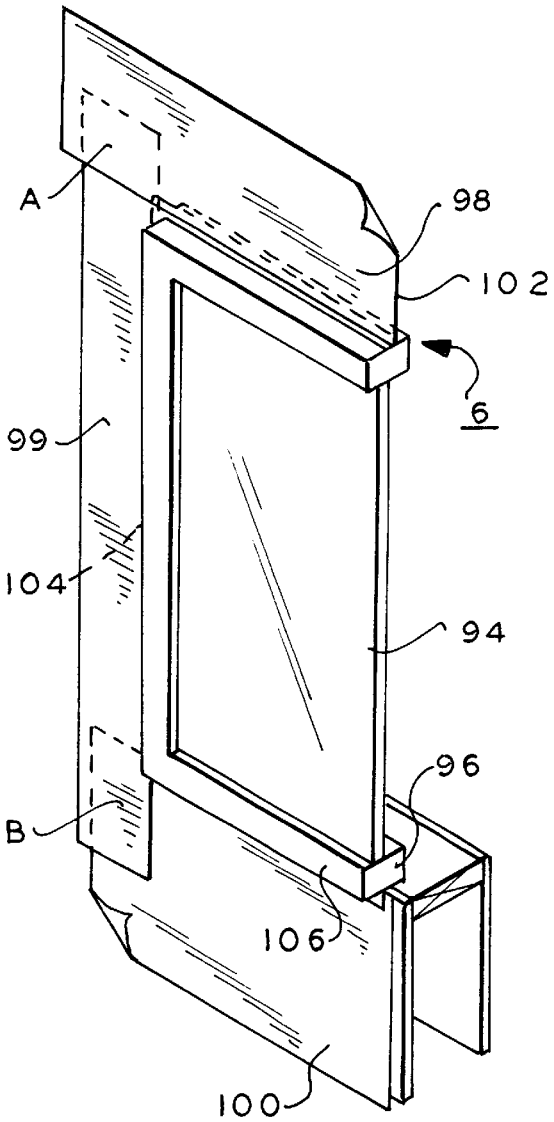
FIG. 1 PRIOR ART
FIG. 1 is an isometric fragmented sectional view of an installed window frame structure with prior art flashing materials.
Figure 5:
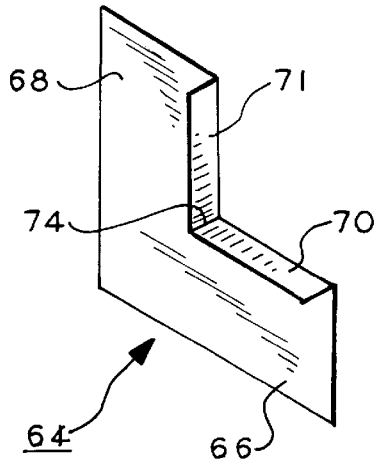
Figure 3:
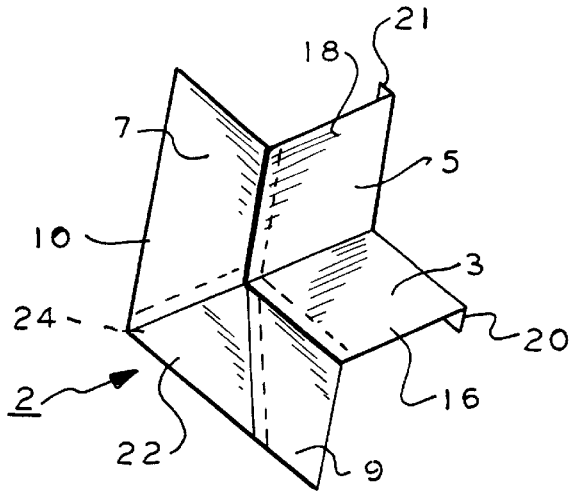
FIG. 3 is an isometric view of a corner barrier membrane seal according to an aspect of the present invention.
Figure 3A:
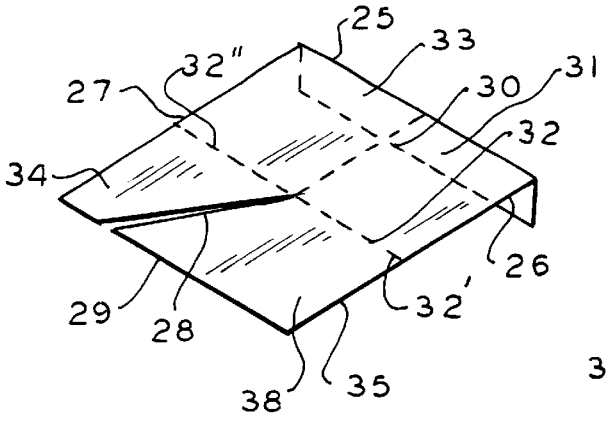
Figure 3B:
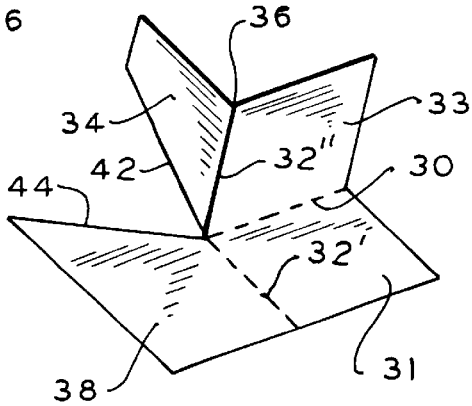
Figure 3C:
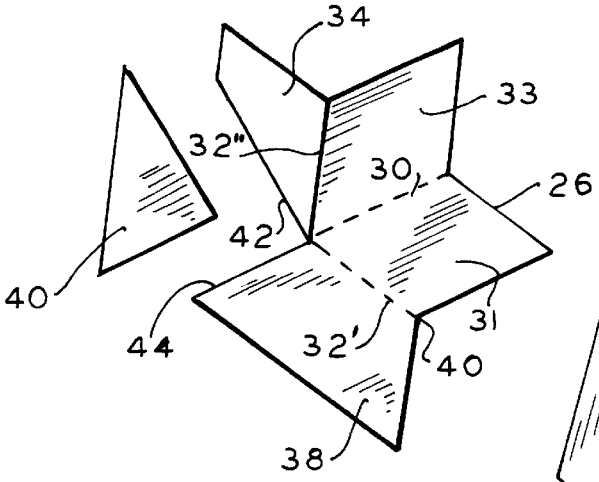
Figure 4:
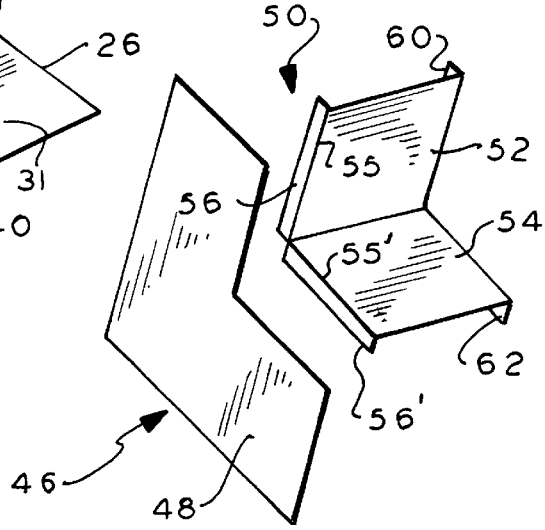
Figure 13:
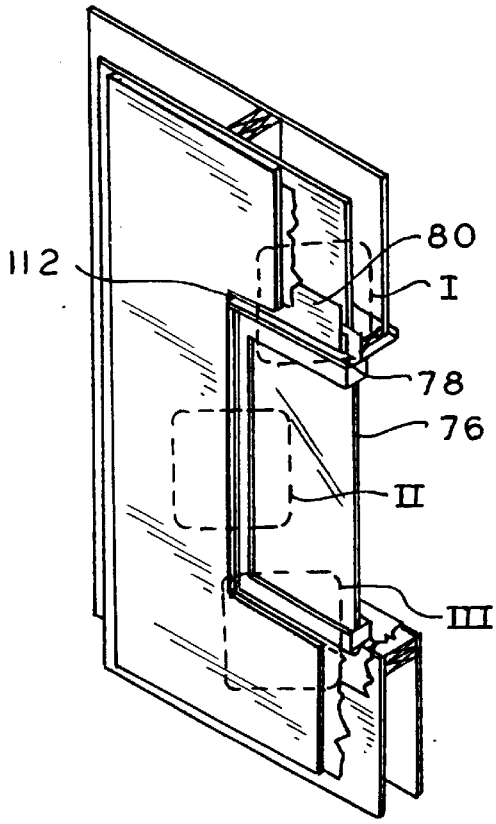
Figure 14:
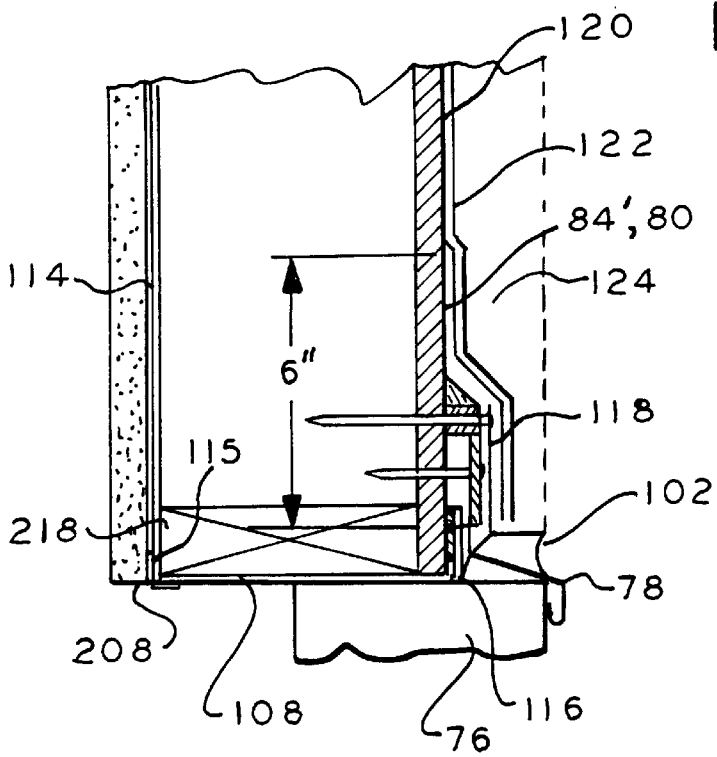
Figure 15:
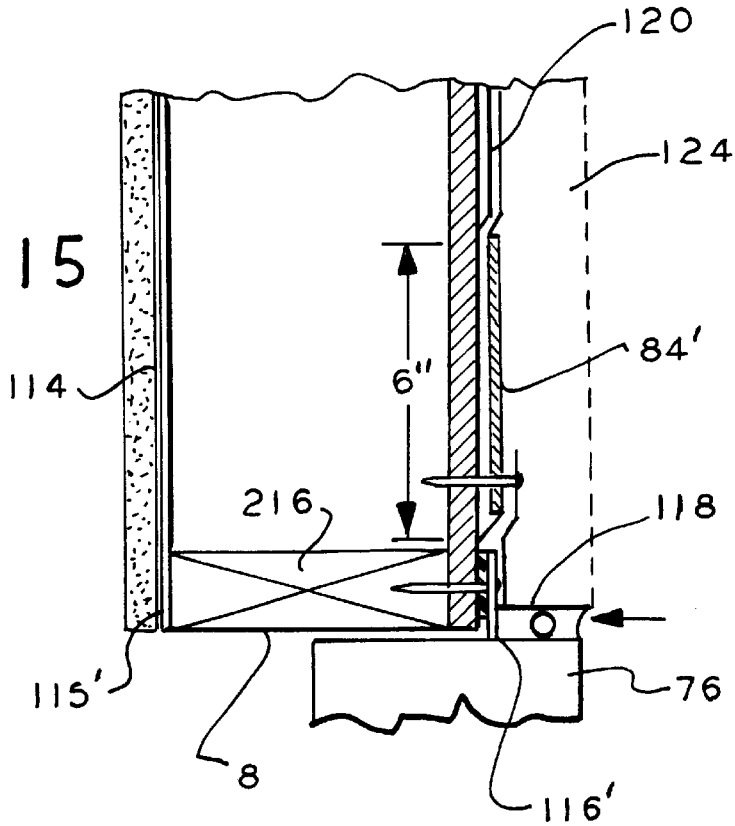

FIGS. 3*a*, 3*b* and 3*c* are various stages of forming the corner membrane seal of FIG. 3;

FIG. 4 is an exploded view of the construction of a further embodiment of a corner barrier membrane seal;

FIG. 5 is an isometric view of a further embodiment of a corner membrane seal for retrofit applications;

FIGS. 6–13 are fragmented sectional isometric views of a window installation at various stages of installation of a window in a new construction with various barriers seals and methodology according to further aspects of the present invention;

FIG. 14 is a cross section elevation view of a window head flashing arrangement taken at region I, FIG. 13;

FIG. 15 is a cross section elevation view of a window jamb flashing taken at region II, FIG. 13;

FIG. 16 is a cross section elevation view of a window sill flashing arrangement taken at region III, FIG. 13;

FIG. 17 is a sectional elevation view of a window in new construction according to an aspect of the present invention;

FIGS. 18–22 are fragmented sectional isometric views of a window installation at various stages of installation of a window with a retrofit seal arrangement, various barriers seals and methodology according to further aspects of the present invention; and FIG. 23 illustrates an elevation sectional view of the retrofit embodiment of FIGS. 18–22.

FIG. 24 illustrates an isometric view of the retrofit embodiment with various barriers seals and methodology.

Figure 2:
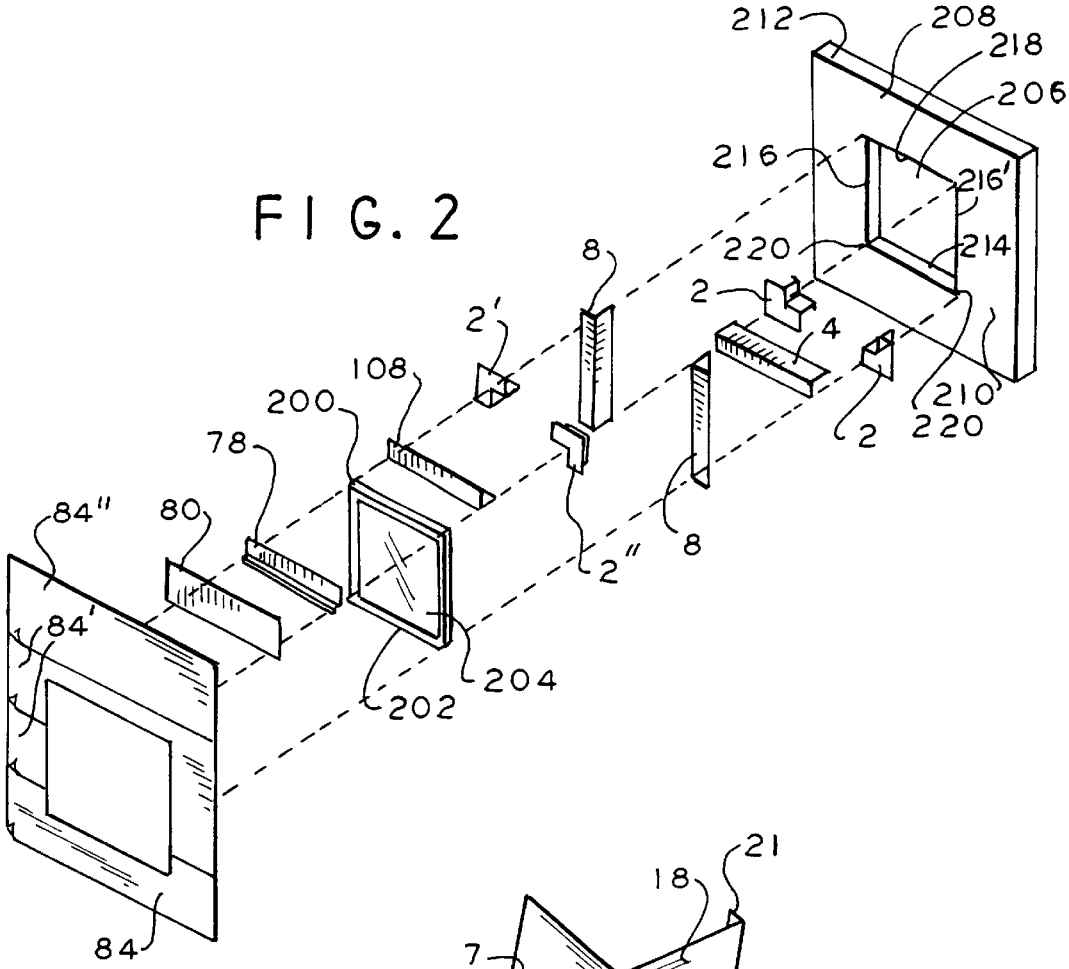
FIG. 2 is an exploded view of a window installation according to an aspect of the present invention.

In FIG. 2, a conventional nail-on window 200 comprises a frame 202 and a transparent pane 204. The window 200 is to be installed in opening 206 in wall 208. The wall 208 has a front face 210 and a rear face 212. The wall 208 opening 206 has a horizontal sill 214, a vertical jamb 216 on each side of the opening, and a horizontal head 218.

Initially two corner seals 2 according to the present invention are attached to the wall 208 over portions of the sill 214, a portion of each of the jambs 216 and a portion of the front face of the wall 208 at each of the lower corners 220.

The corner seal 2 is shown in FIG. 3. The seal 2 comprises a permeable flexible plastic membrane sheet material, e.g., polyethylene, polyvinylchloride (PVC) or thermoplastic polyolefin, for use in new constructions. The sheet material exhibits a high perm rating (e.g., greater than 0.400, preferably about 0.42 and more preferably about 0.468) to release water vapor that may build up at the window perimeter in the interior portions thereof. The water vapor permeates through the material due to pressure differentials across the material rather than collect in interior regions of the wall 208 as condensation. The material of the seal provides a positive moisture seal at the corner of the window frame and overlaps in the adjacent wall regions. The seal 2 incorporates a thermoplastic membrane and woven or non-woven fibrous fleece mesh impregnated on one or both sides of the sheet material to create a rough fibrous surface, such as surfaces 3, 5, 7 and 9, that will provide a tenacious bond to the weather resistive barrier with either a factory of field applied self adhering strip, double sided tape, spray applied adhesive, sealant (skinning or non-skinning), heat weld, chemical bond, or mechanical fasteners. The seal 2, FIG. 2, can bond to either the window frame 202 at the exterior flange thereof or wrap into the window opening 206 to bond to the wall at the sill, head and jamb and interior vapor retarder (not shown in these views) with factory of field applied self adhering strip, double sided tape, spray applied adhesive, sealant (skinning or non-skinning), heat weld, chemical bond, or mechanical fasteners. The seal 2 comprises a prefabricated interior and exterior corner element that can be used to seal the window opening sill, head and jambs to a weather resistive barrier.

The sheet material has a thickness in the range of about 0.020 to about 0.100 inches and preferably about 0.020 to 0.060 inches. The material can be exposed to ambient weather conditions for 6 months without degradation to material performance and is available commercially in a range of widths from 6 inches to 6 feet. The material has the feel and look of a sheet of pliable black rubber. The fibers of the reinforcement are preferably polyester and, in the alternative, may be other fiber materials and provide roughness to a surface of the sheet material.

The prefabricated corner seal 2 includes a face flange 10, FIG. 3, which overlies the front face of the wall 208, a sill or head portion 16 which overlies the sill 214 or head 218 and a jamb portion 18 which overlies a portion of a jamb 216. The seal has fibrous surface 7 that faces away from the wall 208. A self adhering L-shaped optional tape or flange 20 extends from the sill portion 16 at the sill portion rear edge and a flange 21 extends from the jamb portion 18 rear edge. The flanges 20 and 21 are preferably integral and one piece with the respective sill and jamb portions of the corner seal 2. In the alternative, they may be heat sealed or welded. The face flange 10 preferably includes a triangular section 22. Section 22 is bonded by heat welding or with an adhesive to the adjacent edge regions of the seal 2. The rough fibrous surface of the section 22 is exterior of the seal 2 and formed by the embedded polyester fibers arrayed in random fashion. In the alternative, the fibrous surfaces may be on the reverse of the surfaces described.

In FIG. 3*a*, the corner seal 2 is fabricated by forming a preferably square sheet of the membrane sheet 26. A 45 degree slit 28 is formed in the membrane sheet 26 and terminates at edge 29. Two fold lines 30 and 32 are represented by dashed lines forming sections 31, 33, 34 and 38. Fold line 30 extends normal to edge 25 of the sheet to the slit 28 interior end. The fold line 32 is normal to the fold line 30 and extends from edge 27 to edge 35. The fold line 32 has two sections, fold line 32' and foldline 32".

In FIG. 3*b*, the fold section 34 formed by the slit 28 and fold line 32" is folded at fold line 32" to form an exterior corner 36. The section 38 formed by slit 28 and fold line 32' is folded at fold line 32' to from an exterior corner 40, FIG. 3*c*. A triangular section 40 of the same material is welded or otherwise bonded permanently to the sheet material at the spread apart slit 28 edges 42 and 44.

The edges 42 and 44 form a triangular opening in which section 40 is placed and secured in place. The fibrous surface of the section 40 is preferably on the same side of the sheet material as the fibrous surface of membrane sheet 26.

In the alternative, in FIG. 4, a corner seal 46 is formed by an L-shaped sheet membrane 48 of the same material forming the seal 2. A second member 50 has two orthogonal legs 52 and 54. Flange members 56, 56' depend from the outer respective edges 55, 55' of the member 50. Similar flange members 60 and 62 depend from the opposite edges of the respective legs 52 and 54. Flange members 60 and 62 may also be formed on the seal 2, FIG. 3. The seals 2 and 46 are used for new construction.

In a further embodiment, in FIG. 5, a corner seal 64 for retrofit applications of preinstalled windows or doors comprises membrane sheet material that is the same as the material forming seals 2 and 46. The seal 64 has normal coplanar legs 66 and 68 forming an L shape. Flange 70 extends normal to leg 66 from an edge of the leg 66 and flange 71 extends normal to leg 68 from an edge of the leg 68. The flanges 70 and 71 are joined together to form a seal at junction 74.

The corner seals are fitted with a self adhering strip and with a release strip to secure the corner seals to the underlying substrate and to secure the sill, jamb and head membrane seals to the corner seals.

Elongated L-shaped (in transverse cross section) longitudinal seal sill/head member 4 and jamb member 8, FIGS. 2, 6 and 7, are formed of the same sheet material as seal 2. The member 4 can be used for both the sill and head and has a sill/head portion 4' and a front face portion 4". The portion 4' covers the sill 214 or the head 218 inside the opening 206 and sill portions 16 of the corner seals 2 (FIG. 3). The portion 4" overlies a portion of the wall 208 front face 210 and a portion of the face flange 10 of the seals 2 adjacent to the sill portion 16 at each lower corner as shown in FIGS. 2 and 6. The member 4 extends for the width between the jambs 216 (FIG. 2) of the rough opening 206 in the respective sill 214 or the head 218.

The member 8 is the same transverse cross section as the member 4 and is used to cover the jambs 216, 216' on opposite sides of the opening 206, FIG. 2. The member 8, FIG. 7, has a jamb portion 8' that covers a jamb and a front face portion 8" that overlies a portion of the front face 210. The member 8 jamb portion 8' can be cut to form a flange to be adhered onto the exterior front face surface only. The members 4 and 8 are overlaid on the preassembled corner seal 2 at the sill-jamb intersections on opposite sides of the sill 214.

Figure 8:
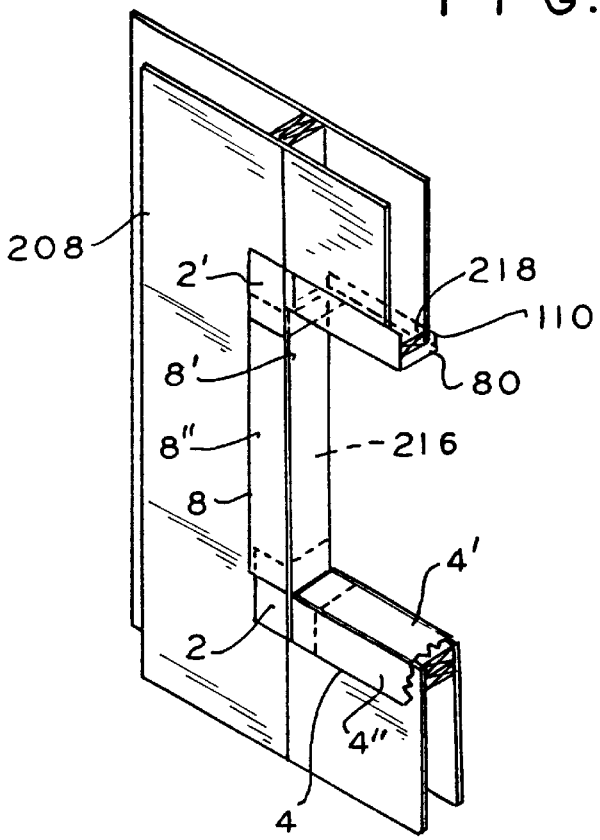

This process is repeated with the head portion of the window opening in FIG. 8. In FIGS. 2 and 8, head corner seal 2' is attached to the wall 208 at the juncture of head 218 and jamb 216. In FIG. 2, corner seal 2" is attached to the wall 208 at the juncture of head 218 and jamb 216' opposite jamb 216. The corners and other seals are attached with the rough surfaces facing the wall 208. In FIG. 8, the elongated head seal 108 is then attached to the head 218. In FIG. 8, the head seal 108 has an additional rear flange 110 which is optional. A similar flange may be formed on all of the corner seals 2, 2' and 2" and on the sill and jamb seals 4 and 108 interconnected to the corner seals 2, 2' and 2". All of the corner seals 2, 2' and 2" are preferably identical. In FIG. 2, a second jamb seal 8 is attached to the jamb 216'. The seal 8 is L-shaped as is the sill and head seals, with an optional flange such as flange 110, FIG. 8. It should be understood that the opposite jamb 8 seals of the window frame are assembled at the same time prior to assembly of the top seals 2' and 2". In all cases, the seals are secured by field or factory applied self adhering strips, double sided tape, spray applied adhesive, a sealant (skinning or non-skinning), heat weld or mechanical fasteners according to a given implementation. The wall 208 is formed on its exterior side with a sheathing substrate.

Figure 9:
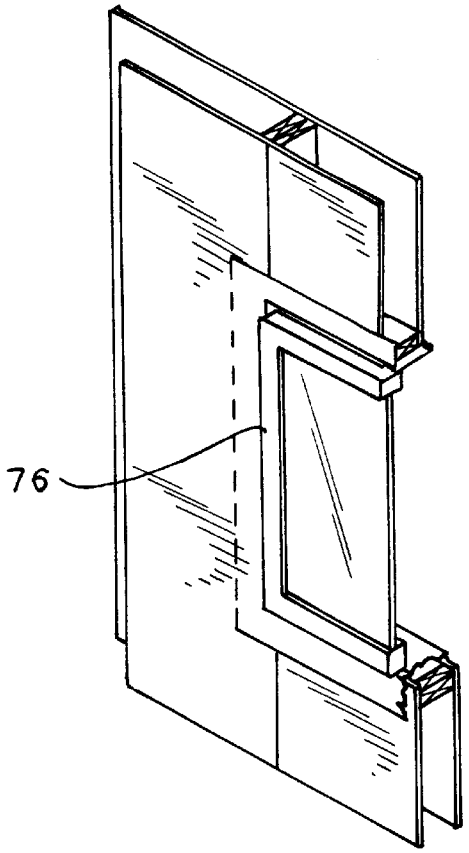
Figure 10:
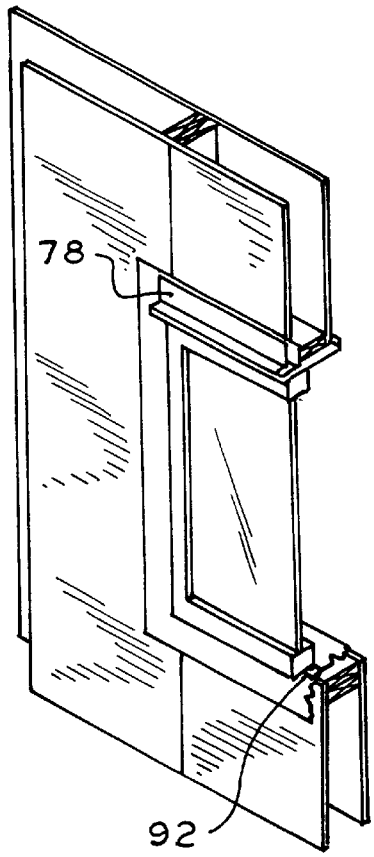

The nail flange window 76 FIG. 9 is then assembled to the now membrane installed window open frame. In FIG. 10, the prefinished metal head flashing 78 is then installed in a bed of non-skinning butyl sealant. A 2 inch sealant end dam 112 is applied under the head flashing to either end, FIG. 13. The flashing 78 is secured with screws but not through the nailing flange 92, FIG. 10. The flashing extends for the full width of the window.

Figure 11:
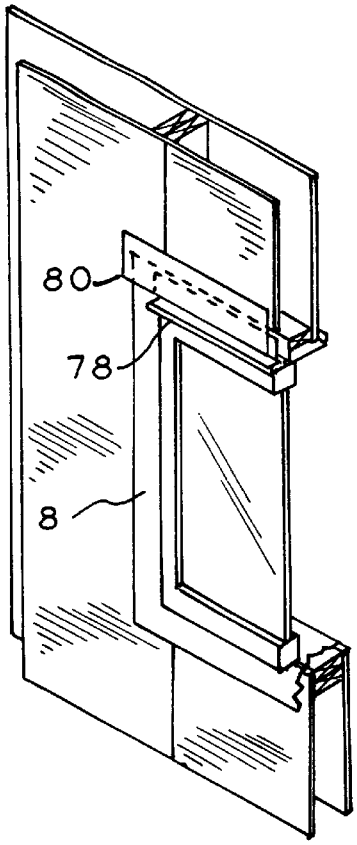
Figure 12:
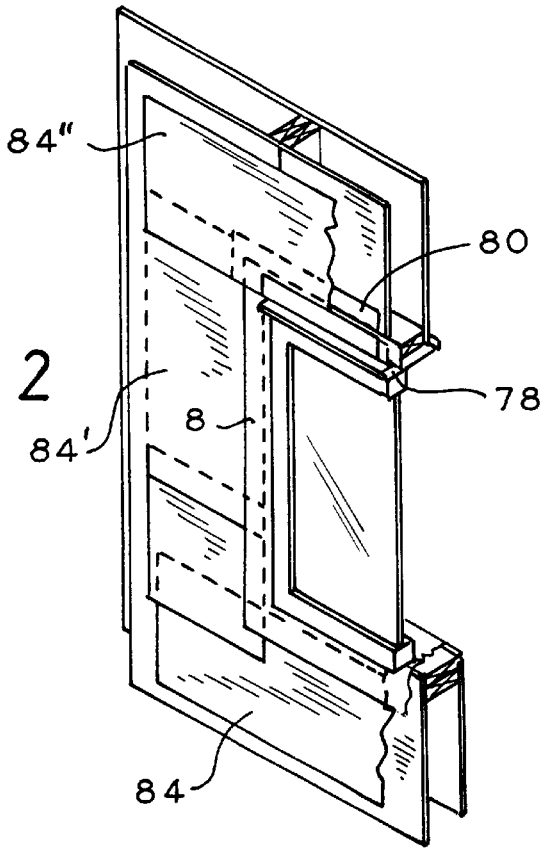

In FIG. 11, a 6" wide membrane, polyethylene composition material weather resistant barrier (WRB) head flashing strip 80 of the same or different material as the corner, sill and head seals is installed over the metal head flashing 78. A strip of sheet material weather resistant barrier 84 (WRB) is secured and lapped under or over the sill and jamb membrane flashings at the sill and jamb with factory of field applied self adhering strip, double sided tape, spray applied adhesive, sealant (skinning or non-skinning), heat weld, chemical bond, or mechanical fasteners. In FIG. 12, WRB 84" is lapped over the metal head flashing at the jambs and over WRB 84' which is over WRB 84. The same sealant may be used throughout. Further finishing is applied as shown in FIG. 13.

In FIG. 14, a conventional vapor retarder 114 is attached to the interior side of wall 208. The head seal 108 is attached to the retarder 114 by a flange such as interior flange 115 where possible or else adhered to the wall 208 frame with factory of field applied self adhering strip, double sided tape, spray applied adhesive, sealant (skinning or non-skinning), heat weld, chemical bond, or mechanical fasteners. The window has a head vinyl nail flange 116 which is set in a continous bead of neutral cure silicone. Head flashing 78 is placed over the latter structure which has been previously sealed with the head seal 108. A weep screed 118, a J-shaped metal member for retaining stucco (as applicable) 124 is placed over the flashing 78. A WRB layer 80 is placed over the flashing 78 (FIG. 2). The six inch membrane flashing 84" is placed over these elements and secured with silicone. Two layers 120 of 60 min. grade D weather resistive barrier sheet material is placed over the above structures. A metal lathe 122 is then placed over the above materials. FIGS. 15–16 show the sectional views of the installation at regions II and III of FIG. 13 wherein like numbers represent like materials in the other figures. In FIG. 15 the seal 8 is shown with an interior flange 115', preferably about one inch wide, as in all of the flanges of the various sill, head and jamb seals, which is bonded to the vapor retarder 114. This interior flange may be nothing more than an extension of the sill, jamb and head portions of the seal which is bent at the vapor retarder in order to bond it to the retarder where possible. A one half inch sealant joint 226 has a closed cell backer rod.

The material forming the corner, sill, head and jamb seals can be heat welded which is not true of the Moistop seal of the prior art. The prior art materials used as seals known at Moistop can not be heat welded and has a relatively low perm of 0.3, which is not desirable as this provides negligible vapor penetration through the material with respect to the 0.468 perm of the material used in the seals of the present invention.

In FIG. 17, window nail frame 92 is set in a sealant bead. A metal head flashing 78 is set in sealant. A WRB 126 is over the metal flashing 78. A reinforcing mesh 128 is adhered to the substrate. A membrane head flashing 130 is adhered to the metal flashing 78 and membrane head seal 108. The seal 108 has a flange 110 adhered to the vapor retarder 114. The seal 4 has a flange 132 sealed to the retarder 114. FIG. 2 shows the sequence in exploded form for the corner seal 2 installation.

Figure 18:
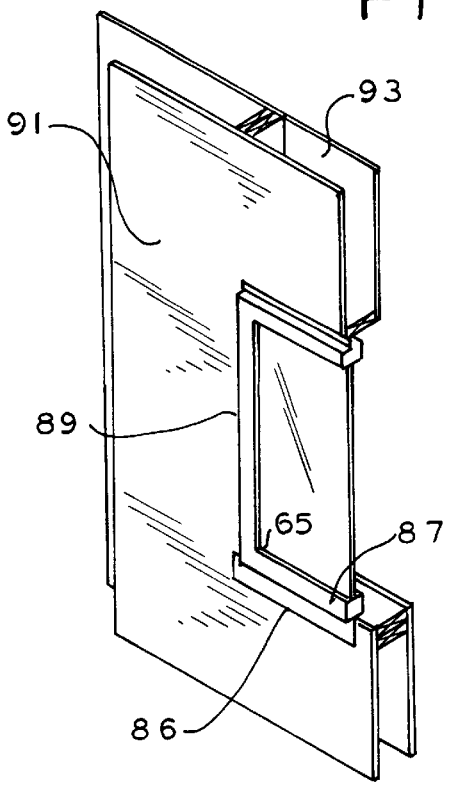
Figure 19:
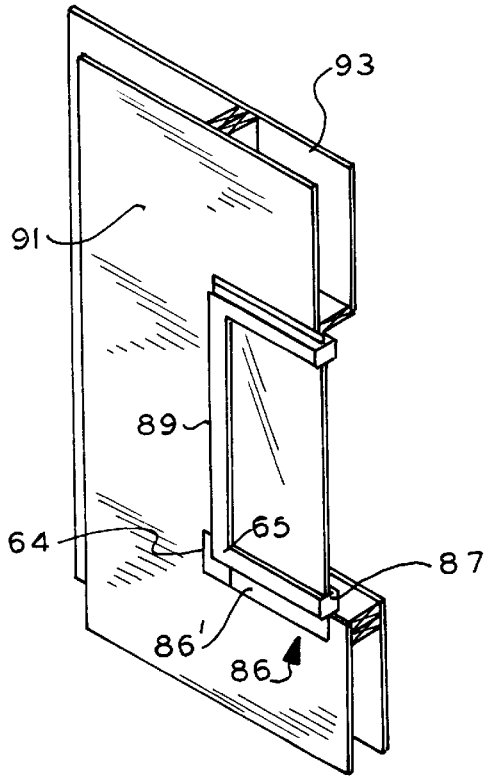
Figure 19A:
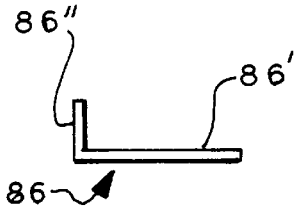
Figure 20:
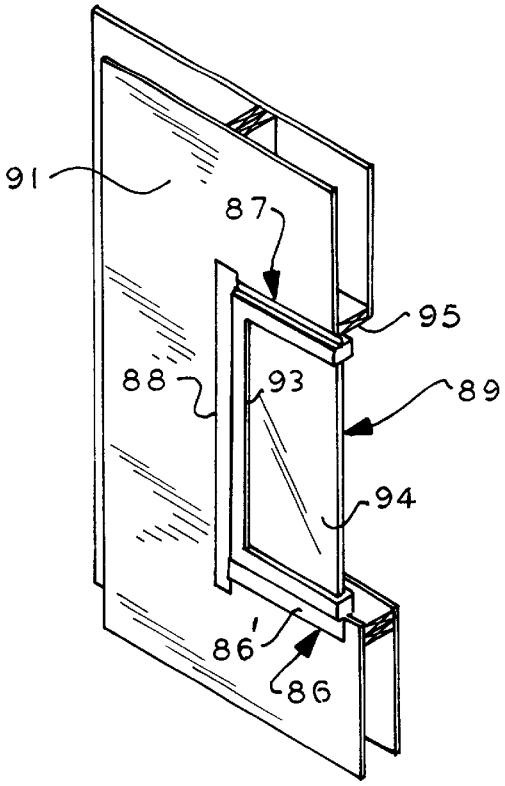

In FIGS. 18–23 a retrofit seal installation is shown of a flashing system where the window assembly is already in place and cannot be removed without damaging the interior window trim and insulation installed in the framing void between the window profile and the wood framing. In FIG. 18, in a retro fit application to a preinstalled window, a sill strip seal 86 of the same material as discussed above in respect of corner seal 2, is installed beneath the sill frame 87 of the window 89. The sill seal 86, FIG. 19*a*, is L-shaped and has a leg portion 86' bonded to the sheathing 91 on the exterior of wall 93 and a leg portion 86" that is at right angles to the sheathing bonded to the under side of the window 89 sill frame 87.

A corner seal 64 (FIG. 5), of the same material as seal 2, is installed at the window 89, having a pane 94, outer lower corners 65, FIG. 24, over the sill frame portion that is normal to the sheathing 91 and over the jamb portion normal to the sill portion. The seal 64 also has a portion that is bonded over the sheathing 91. For example, flange 70 of seal 64, FIG. 5, is bonded to the lower surface of the sill frame 87. The leg 66; is bonded over the sill seal 86. The flange 71 is bonded to the jamb frame 87. The leg 68 is bonded to the sheathing 91.

Jamb strip seals 88, 88', comprising membrane material of the same construction as seal 2 and seal 86, are then installed over the corner seals 64. The seal 88, at a leg thereof corresponding to leg 86' of seal 86, FIG. 19*a*, is bonded and sealed to the sheathing 91 and to corner seal 64. A second leg of seal 88 corresponding to leg 86", FIG. 19*a*, is bonded to the window frame 87 at the jamb 93 and also overlies the corner seal 64 on the jamb portion. The membrane seals 86 and 88 are adhered to the window frame 89 and not to the nailing flange.

Figure 21:
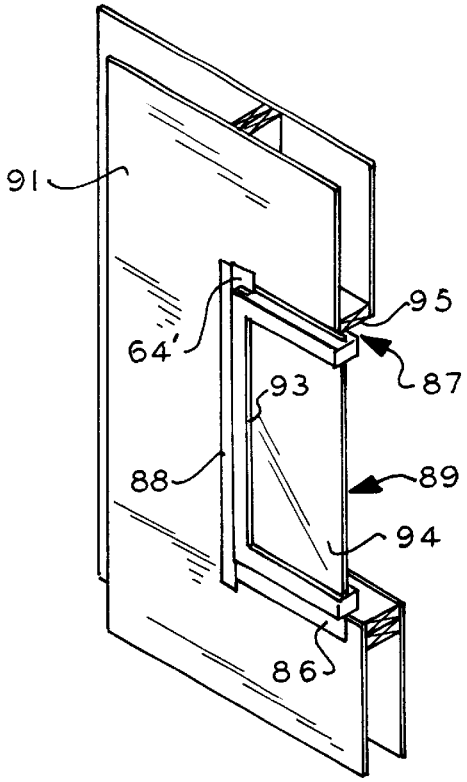
Figure 22:
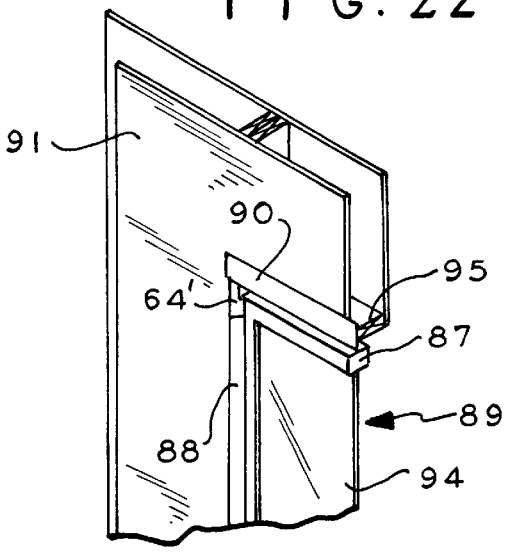

In FIGS. 21 and 24, upper corner seals 64' are bonded and sealed to the sheathing and to the frame 89 at head 95 and over the jamb seals 88 and 88' in a manner similar to the lower corner seals 64. In FIG. 22, head seal 90, which is L-shaped as seal 86, FIG. 19*a*, is attached to the sheathing at head 95 and to the window 89 frame 87 at the head and overlies upper corner seal 64'.

FIG. 23 shows the sectional view of the installed seals and flashings in the retrofit embodiment. In FIG. 23, the window has an existing WRB 133. A reinforcing fabric 138 is sealed to existing substrate or WRB 133. A new weather resistive barrier 136 is placed over the fabric 138 and over the prefabricated corner and strip flashing formed by corners 64' and strip head seal 90.

Thus a thermoplastic flashing system is described that incorporates a strip sheet material membrane with a woven or non-woven polyester or polypropylene reinforcement encapsulated into the thermoplastic sheet material of the membrane. This provides both reinforcement for the thermoplastic sheet material and a mechanical bonding surface for bonding to the weather resistive barrier or underlying substrate. An optional factory or shop applied self adhering seal strip may be applied to any surface to ease installation in the field. Preformed corners are placed at all four corners of a wall penetration to provide a watertight seal at vertical to horizontal transitions. The prefabricated corners may be fitted with a self-adhering seal strip with a release backing to secure the corners to the underlying substrate and to secure the membrane strips to the corner pieces. Alternatively, the corners and strips may be secured and joined with field applied sealant.

In addition to the use of self-adhering strips or sealant, the thermoplastic strip can be heat welded, solvent welded or adhered with a sealant to form the desired seals. The corners are formed from two pieces with either a single or a double weld to bond the sections together (FIGS. 3, 3*a*, 3*b* and 3*c*). The corner provides water proofing protection at the corner where the membrane changes plane. The corner piece can extend into the window opening to the interior vapor retarder. The sheet material forming the 90° angle can be cut to form the flange 20 (FIG. 3) to bond to an interior vapor retarder. The corners are connected with a membrane strip (sections 4 and 8, FIG. 7) of the same material as the corners. The components are installed in such a manner that all joints shed water.

In FIGS. 2 and 17 system, a compression seal is formed at the window flange with a preinstalled sealing tape at the transition. In the alternative, a two-sided foam, sealant or butyl tape (not shown FIG. 17) is field applied to form a compression seal under the nailing flange 92.

The sheet material used as a sealant membrane in the disclosed embodiments herein is commercially available. This material has been used as a tank liner, roofing liner and pool liner, among other uses. This material, however, has never been used as a window or door flashing in the manner disclosed herein.

It will recur to one of ordinary skill that various modifications may be made to the disclosed embodiments without departing from the scope of the invention as defined on the claims appended hereto.

What is claimed is:

1. A seal construction for a nail-on window or door frame, the frame for installation in a window or door opening in a wall, the opening being formed by a horizontal sill, a horizontal head and vertical jambs connecting the sill to the head, the wall at the sill, head and jambs having front and rear faces, the seal construction comprising:

an integral unitary corner pliable sheet material seal member exhibiting a breathable perm value that repels liquid water applied to a surface thereof and which permits water vapor to permeate therethrough in response to a pressure differential thereacross to preclude substantial condensation collection in the interior of said opening while providing a water barrier to liquid water applied thereto;

the seal member comprising a first portion for overlying a selected portion of one of the head and sill, a second jamb portion normal to the first portion and sealingly connected to the first portion for overlying a portion of the jamb at said selected one of the head and sill and a third front face portion sealingly connected to and normal to the first and second portions for overlying the front face of the wall adjacent to the selected one of the head and sill portions and adjacent to the jamb portion.

2. The seal construction of claim 1 wherein at least a portion of a first surface of the seal member includes embedded reinforcing fibers for enhancing sealant adherence to the first surface.

3. The seal construction of claim 1 wherein the first and second portions are each planar connected by a right angle joint therebetween, the third portion comprising an L-shaped member having a first leg depending from the first portion at a right angle thereto and a second leg extending at a right angle to the first leg and extending from the second portion at a right angle thereto.

4. The seal construction of claim 1 further including a fourth rear portion for overlying a portion of the rear face at the selected one of the sill and head, the fourth portion depending from the first portion and juxtaposed with the first leg, and a fifth rear portion extending from the second portion juxtaposed with the second leg for overlying a portion of the rear face at the jamb.

5. The seal construction of claim 4 wherein the first and second portions and a portion of the first and second legs are formed of one piece sheet material, further including a triangular interface section between and bonded to at least a portion of the first and second legs.

6. The seal construction of claim 4 wherein the first and second portions comprise integral one piece sheet material, the first and second portions each having a flange depending therefrom for overlying the rear face, and comprising an L-shaped planar sheet member.

7. A method of making a seal construction for a window or door opening in a wall for receiving a nail-on frame, the frame for insertion into the opening formed by a horizontal sill, a horizontal head and vertical jambs connecting the sill to the head, the wall at the sill, head and jambs having front and rear faces, the method comprising:

forming a flat pliable liquid water impervious first sheet having a perm sufficient to permit water vapor to permeate therethrough to preclude condensation from substantially accumulating on a side thereof;

forming a slit with opposing edges in the sheet in communication with a first sheet edge; and spreading the opposing edges apart and sealingly attaching a second sheet made of the same material as the first sheet to the opposing edges of the slit to form a one piece sheet member having a sill or head portion for overlying a sill or head of the opening, a jamb portion for overlying a portion of the opening jamb normal to the sill or head portion and a front face portion for overlying the front face of the wall at the sill or head and adjacent jamb.

8. The method of claim 7 further comprising forming a rear flange portion extending from a second edge of the sheet material opposite the first edge for overlying a portion the rear faces of the seal or head and jamb.

9. The method of claim 8 wherein the sheet material has a first fold line extending thereacross to opposing second and third sheet material edges and a second fold line extending from a fourth edge of the sheet material medially the second and third edges normal to the first fold line and terminating at the first fold line, the slit extending from the junction of the first and second fold lines to the first edge.

10. A method of making a seal construction for a nail-on a window or door opening in a wall, the opening being formed by a horizontal sill, a horizontal head and vertical jambs connecting the sill and head, the wall at the sill, head and jambs having front and rear faces, the method comprising:

forming a corner seal from a flat sheet of a liquid water repellant pliable material having a perm sufficient to permit water vapor to pass therethrough in response to a pressure differential across opposing sides of the material to preclude condensation on a first side thereof while repelling liquid water incident thereon on a second side, the corner seal comprising a flat first portion for overlying the sill or head and a flat second portion for overlying the jamb, the second portion being integral and one piece with the first portion; and forming a flat front face member sealingly attached to the first and second portions for overlying a portion of the front face of the wall at the sill or head and jamb.

11. The method of claim 10 wherein the method of forming the sheet includes forming the sheet of fiber reinforced polyethylene having a smooth first surface and a fibrous second surface.

12. The method of claim 11 including attaching the corner seal to the sill or head and jamb with a sealant at the fibrous surface.

13. A method of sealing a window or a door opening in a wall, the opening being formed by a horizontal sill, a horizontal head and vertical jambs connected to the sill and to the head, the wall at the sill, head and jambs having front and rear faces, the method comprising:

forming a corner seal member of pliable sheet material that repels liquid water applied to a surface thereof and which permits water vapor to permeate therethrough in response to a pressure differential thereacross, the seal member comprising a first portion for overlying a selected portion of one of the head and sill, a second jamb portion normal to the first portion and sealingly connected to the first portion for overlying a portion of the jamb at said selected one of the head and sill and a third front face portion sealingly connected to and normal to the first and second portions for overlying the face of the wall adjacent to the selected one of the head and sill portions and adjacent to the jamb portion;

attaching the seal member to each of two lower interior corners of the window or door opening at the juncture of the sill and jambs at each end of the sill;

forming sill, head and jamb seal members each comprising an elongated L-shape in section member formed of said pliable sheet material and including a first leg portion and a second leg portion;

attaching the sill seal member first leg portion over the first portions of the corner seal member at each lower corner of the window or door opening and the second leg portions thereof over the front face;

attaching said jamb seal member first leg portion over each vertical jamb and over the second jamb portions of each said attached corner seal member at said lower corners and the second leg portions thereof over the front face;

then attaching a corner seal member second portion over the jamb seal members at each upper corner of the opening and the first portion over a portion of the head; and then attaching a head seal member first leg over the first portions of the corner seal members at the head-jamb corners of the frame and over the head and the second leg portions over the front face at the head.

14. A method of retrofit sealing an installed window or door and frame, the frame for enclosing an opening in a wall formed by a horizontal sill, a horizontal head and vertical jambs connected to the sill and to the head, the wall at the sill, head and jambs having front and rear faces, the method comprising:

sealingly attaching a first flat strip of sheet pliable sheet material on the exterior surface of the wall front face adjacent to the sill, the sheet material repelling liquid water applied to a surface thereof and which permits water vapor to permeate therethrough in response to a pressure differential thereacross;

forming a plurality of corner members each comprising said sheet material, the corner members comprising an L-shaped planar element with a first leg and a second leg normal to the first leg, a first flange extending outwardly from the first leg and a second flange extending outwardly from the second leg, the first and second flanges being sealing joined to each other and to the legs at the juncture therebetween and the legs;

sealingly attaching the legs of a first corner member to the front face at the juncture of the sill and a first jamb to the front face at the juncture of the sill, sealingly attaching the first flange of the first corner member to the frame adjacent to the sill and the second flange to the frame adjacent to the first jamb and sealingly attaching a second corner member to the front face at the juncture of the sill and a second jamb and to the frame in the same manner as the first corner member;

sealingly attaching a second flat strip of said sheet material on the front face adjacent to the first and second jambs over a leg of the corner members at each corner at the junction of the sill and jambs;

sealingly attaching a third corner member to the front face over the second flat strip with the first leg adjacent the first jamb and the second leg adjacent to the head and repeating this step with a fourth corner at the second jamb and head; and sealingly attaching a further flat strip to the exterior surface adjacent to the head over a leg of each of the third and fourth corners and a flange attached to the further flat strip to the frame at the head.

15. A retrofit seal construction for an installed window or door frame in a wall having front and rear faces, the frame for enclosing an opening in the wall formed by a horizontal sill, a horizontal head and vertical jambs connecting the sill to the head, the seal construction comprising:

an integral unitary corner member seal formed of pliable sheet material exhibiting a breathable perm value that repels liquid water applied to a surface thereof and which permits water vapor to permeate therethrough in response to a pressure differential thereacross to preclude substantial condensation collection in the interior of said wall at the opening while providing a water barrier to liquid water applied thereto;

the corner member seal comprising an L-shaped planar element of said material with a first leg and a second leg normal to the first leg for overlying the front face of the wall adjacent to the frame and a first flange extending outwardly from the first leg for overlying and attachment to the frame adjacent to the sill or head and a second flange extending outwardly from the second leg at a right angle to the first flange for overlying and attachment to the frame adjacent to a jamb, the first and second flanges being sealing joined to each other and to the legs at the juncture therebetween and the legs.

16. The seal construction of claim 15 wherein the corner member is one piece sheet material.

17. The seal construction of claim 15 wherein the sheet material comprises polyethylene reinforced with fibers to form a smooth surface on one side and a rough fibrous second side adapted to adheringly receive an adhesive.

18. A method of sealing a window or door opening comprising applying pliable sheet material exhibiting a breathable perm value greater than 0.4 that repels liquid water applied to a surface thereof and which permits water vapor to permeate therethrough in response to a pressure differential thereacross to preclude substantial condensation collection in the interior of said wall at the opening while providing a water barrier to liquid water applied thereto to the sill, jambs and head interior surfaces of a window or door opening in a plurality of bonded strips and to the external sheathing at said sill, jambs and head.

19. The method of claim 18 including additionally applying said sheet material to the exterior surface of the wall surrounding said sill, jambs and head and forming a sealed joint with the material applied to said sill, jambs and head interior surfaces.

20. A seal construction for a nail-on window or door frame, the frame for installation in a window or door opening in a wall, the opening being formed by a horizontal sill, a horizontal head and vertical lambs connecting the sill to the head, the wall at the sill, head and jambs having front and rear faces, the seal construction comprising:

an integral pliable sheet material seal member exhibiting a breathable perm value that repels liquid water applied to a surface thereof and which permits water vapor to permeate therethrough in response to a pressure differential thereacross to preclude substantial condensation collection in the interior of said opening while providing a water barrier to liquid water applied thereto;

the seal member comprising a first portion for overlying at least a selected portion of one of the head and sill, the sill and head each having opposing first and second ends, a second jamb portion normal to the first portion for overlying at least a portion of a first jamb at the sill first end, a third jamb portion normal to the first portion for overlying at least a portion of a second jamb at the sill second end, first and second corner portions for overlying the junction between said selected one of the head and sill and the respective first and second jambs, and a fourth front face portion normal to the first, second and third portions for overlying at least a portion of the front face of the wall adjacent to the selected one of the head and sill portions and adjacent to the first and second jamb portions.

21. A seal construction for a nail-on window or door frame, the frame for installation in a window or door opening in a wall, the opening being formed by a horizontal sill, a horizontal head and vertical lambs connecting the sill to the head, the wall at the sill, head and jambs having front and rear faces, the seal construction comprising:

an integral unitary pliable sheet material seal member exhibiting a breathable perm value that repels liquid water applied to a surface thereof and which permits water vapor to permeate therethrough in response to a pressure differential thereacross to preclude substantial condensation collection in the interior of said opening while providing a water barrier to liquid water applied thereto;

the seal member comprising a first portion for overlying a portion of one of the head and sill, a second jamb portion normal to the first portion for overlying a portion of the jamb at said one of the head and sill and a third front face portion normal to the first and second portions for overlying the front face of the wall adjacent to the selected one of the head and sill portions and adjacent to the jamb portion wherein the first and second portions form a fourth portion which overlies the junction between the sill portion and jamb portion.

22. The seal construction of claim 21 wherein the first portion is arranged for overlying the entire selected sill or head and further including a fifth portion for overlying at least a portion of a second jamb at the sill second end and normal to the first portion.

23. A method of sealing a window or door opening comprising applying pliable sheet material to at least one of a sill and head and to at least one jamb between the sill and head and to the external wall surface at said at least one sill and head and at said at least one jamb, the material exhibiting a breathable perm value which permits water vapor to permeate therethrough in response to a pressure differential thereacross to preclude substantial condensation collection in the interior of said wall at the opening, said sheet material also for repelling liquid water applied to a surface thereof to provide a water barrier to liquid water applied thereto.

24. The method of claim 23 including the step of applying the material to two jambs at opposite ends of the at least one sill and head and for overlying the junctions between the at least one sill and head and the two jambs.

25. A window seal construction for sealing a window or door opening comprising:

a pliable sheet material arranged for application to at least one of a sill and head and to at least one jamb between the sill and head and to the external wall surface at said at least one sill and head and at said at least one jamb, the material exhibiting a breathable perm value which permits water vapor to permeate therethrough in response to a pressure differential thereacross to preclude substantial condensation collection in the interior of said wall at the opening, said sheet material also for repelling liquid water applied to a surface thereof to provide a water barrier to liquid water applied thereto.

* * * * *

UNITED STATES PATENT AND TRADEMARK OFFICE

CERTIFICATE OF CORRECTION

PATENT NO. : 6,725,610 B2
DATED : April 27, 2004
INVENTOR(S) : Colin Murphy et al.

It is certified that error appears in the above-identified patent and that said Letters Patent is hereby corrected as shown below:

Column 15,
Line 28, change “lambs” to -- jambs --

Signed and Sealed this

Twentieth Day of July, 2004

JON W. DUDAS
*Acting Director of the United States Patent and Trademark Office*